US008408650B2

(12) United States Patent
Jacobs et al.

(10) Patent No.: US 8,408,650 B2
(45) Date of Patent: Apr. 2, 2013

(54) MODULAR HIGHCHAIR WITH HEIGHT ADJUSTMENT

(75) Inventors: Imre Peter Jacobs, Utrecht (NL); Martijn Hans Van Gelderen, Amsterdam (NL); Eric Biermann, Amsterdam (NL); Fiona Amy Van Petegem, Amsterdam (NL)

(73) Assignee: Nuna International B.V., Amsterdam Zuidoost (NL)

( * ) Notice: Subject to any disclaimer, the term of this patent is extended or adjusted under 35 U.S.C. 154(b) by 393 days.

(21) Appl. No.: 12/309,688

(22) PCT Filed: Jul. 19, 2007

(86) PCT No.: PCT/EP2007/006427

§ 371 (c)(1),
(2), (4) Date: Jan. 27, 2009

(87) PCT Pub. No.: WO2008/012025

PCT Pub. Date: Jan. 31, 2008

(65) Prior Publication Data

US 2009/0315379 A1 Dec. 24, 2009

Related U.S. Application Data

(60) Provisional application No. 60/834,207, filed on Jul. 28, 2006.

(51) Int. Cl.
*A47C 1/00* (2006.01)

(52) U.S. Cl. ..... 297/344.18; 297/344.14; 297/130

(58) Field of Classification Search ..... 297/344.18, 297/344.14, 130, 232, 344.12; D6/367
See application file for complete search history.

(56) References Cited

U.S. PATENT DOCUMENTS

| | | | | |
|---|---|---|---|---|
| 573,133 | A * | 12/1896 | Browne | 297/338 |
| 2,605,815 | A * | 8/1952 | Zoranovich | 297/250.1 |
| 2,692,637 | A | 10/1954 | Rainwater | |
| 3,127,217 | A | 3/1964 | Caplan | |
| 4,718,717 | A * | 1/1988 | Cruz | 297/135 |
| 5,165,755 | A * | 11/1992 | Rho | 297/344.18 |
| 5,328,240 | A * | 7/1994 | Neumuller | 297/338 |
| 5,468,043 | A * | 11/1995 | Chien | 297/153 |
| 5,520,433 | A * | 5/1996 | Tokutake et al. | 297/131 |
| 5,558,400 | A * | 9/1996 | Poulson et al. | 297/344.18 |
| 5,630,649 | A * | 5/1997 | Heidmann et al. | 297/344.19 |
| 6,050,643 | A * | 4/2000 | Kain et al. | 297/344.18 |
| 6,082,814 | A * | 7/2000 | Celestina-Krevh et al. | 297/118 |
| 6,089,653 | A * | 7/2000 | Hotaling et al. | 297/130 |
| 6,095,607 | A * | 8/2000 | Wenzel | 297/344.18 |
| 6,161,898 | A * | 12/2000 | Brevi | 297/328 |
| 6,715,827 | B1 * | 4/2004 | Chen | 297/148 |
| 6,877,801 | B2 * | 4/2005 | Asbach et al. | 297/16.1 |
| 6,877,805 | B1 * | 4/2005 | Steadman | 297/130 |
| 6,951,371 | B2 * | 10/2005 | Wang | 297/344.14 |
| 7,445,293 | B2 * | 11/2008 | Smith et al. | 297/484 |
| 7,753,448 | B2 * | 7/2010 | Chen et al. | 297/344.18 |
| 7,832,801 | B2 * | 11/2010 | Driessen | 297/344.18 |

* cited by examiner

FOREIGN PATENT DOCUMENTS

| | | |
|---|---|---|
| DE | 198 57 747 A1 | 6/2000 |
| GB | 971 253 A | 9/1964 |

*Primary Examiner* — David Dunn
*Assistant Examiner* — Erika Garrett
(74) *Attorney, Agent, or Firm* — Bacon & Thomas, PLLC

(57) ABSTRACT

A highchair comprising a base arranged to rest on a floor, a carrier mounted on said base and adjustable in a substantially vertical direction with respect to said base, and a seat comprising a substantially horizontally extending seat surface connected to said carrier, wherein said carrier extends substantially downward from the front edge of said seat surface.

32 Claims, 10 Drawing Sheets

MODULAR HIGHCHAIR WITH HEIGHT ADJUSTMENT

CROSS-REFERENCE TO RELATED APPLICATIONS

This application claims benefit under 35 U.S.C. 119 (e) of U.S. Provisional Patent Application Ser. No. 60/834,207 filed Jul. 28, 2006, the whole of which is incorporated herein by reference.

FIELD OF THE INVENTION

The invention relates to a highchair. In particular the invention relates to a highchair with height adjustment, comprising a base arranged to rest on a floor and a seat connected to said base comprising a substantially horizontally extending seat surface, wherein the seat is adjustable in a substantially vertical direction with respect to said base.

BACKGROUND OF THE INVENTION

Highchairs for children with height adjustment to accommodate for their growth are well-known in the field. Such highchairs are for instance described in U.S. Pat. No. 4,109,961, international patent application publication no. WO 95/30360 and international patent application publication no. WO 2006/031112. In those highchairs the height of the seat surface can be adjusted by moving the seat up and down along two uprights of the base.

The inventions aims at a highchair that is comfortable and safe, that can be used in many stages of a child's life and that is easy to adjust and use.

SUMMARY OF THE INVENTION

According to one aspect of the invention the modular highchair comprises a base arranged to rest on a floor, a carrier mounted on said base and adjustable in a substantially vertical direction with respect to said base, and a seat comprising a substantially horizontally extending seat surface connected to said carrier, wherein said carrier extends substantially downward from the front edge of said seat surface. Such an arrangement makes it easy to adjust the height of the seat, and furthermore there is no need for unnecessary parts of the base to extend above the seat surface when the seat is in the lower positions, as the entire base can remain under the seat surface at all heights. Also an empty space is provided between the base and the seat.

Preferably a backrest extends substantially upward from the rear edge of said seat surface. The height of the backrest thereby does not change when the height of the seat adjusted.

Preferably said carrier is mounted on and movable up and down along the front side of said base.

Preferably said carrier extends downward and slightly forward from said front edge of said seat surface. Preferably said carrier forms a leg support of said seat. Preferably said carrier is substantially plate shaped. The carrier is thereby completely integrated in the seat.

Preferably said base comprises two spaced apart front legs, and preferably said base also comprises two spaced apart rear legs. Preferably said base comprises two spaced apart front legs and a cross member connected to the front legs, wherein said carrier is movable on the cross member. Preferably said front and rear legs are connected by a horizontally extending substantially H-shaped or U-shaped connecting portion. Preferably said connecting portion is substantially U-shaped, wherein the lateral connecting portion of said U-shape extends near the front side of the base, and said carrier is mounted to said lateral connecting portion of said U-shaped connecting portion.

Preferably the highchair comprises a locking device for locking the seat at a desired height relative to the base, said locking device comprising a lever being formed by a lower portion of said carrier and movable between a locked position wherein said lower portion extends in the lateral plane through the carrier, and an unlocked position wherein said lower portion extends in front of said plane.

Preferably the lever is a hinged lever mounted on the carrier with at least one cam, and at least one substantially vertical rack mounted on the base having a scalloped surface with ridges and grooves, such that the cam can be rotated around the hinge axis into and out of a chosen groove of the rack in order to lock the vertical movement of the seat. Preferably said lever is hinged at its upper end, and extends downward abutting a fixed portion of the carrier in the locked position. Preferably said lever comprises a secondary lock for locking the lever against the carrier in the locked position. Preferably said secondary lock comprises an operating handle near the lower edge of the lever for operating the secondary lock.

Preferably said lever is plate shaped and is integrated in the plate shaped carrier in the locked position.

Preferably said highchair comprises at least one gas spring, one end of which is mounted on the base and the other end of which is mounted on the seat. Preferably said gas spring extends substantially vertically in the carrier.

Preferably said carrier is mounted on the base by means of at least one substantially vertical guide member mounted on one of said base and carrier and a connector member mounted on the other one of said base and carrier, meshing with said guide member and vertically movable along it. Preferably said connector member is detachably connected to said guide member, such that the seat and carrier is detachable from the base. Preferably the connector member and guide member are arranged such, that the connector member can be lifted from the guide member if the seat is moved beyond the uppermost position.

According to another aspect of the invention the highchair comprises a base arranged to rest on a floor, a carrier mounted on said base and adjustable in a substantially vertical direction with respect to said base, and a seat comprising a substantially horizontally extending seat surface connected to said carrier, wherein said base entirely extends under the plane of said seat surface.

According to another aspect of the invention the highchair comprises a base arranged to rest on a floor, a carrier mounted on said base and adjustable in a substantially vertical direction with respect to said base, and a seat comprising a substantially horizontally extending seat surface connected to said carrier, wherein the highchair comprises a locking device for locking the seat at a desired height relative to the base, said locking device comprising a hinged lever mounted on the carrier with at least one cam, and at least one substantially vertical rack mounted on the base having a scalloped surface with ridges and grooves, such that the cam can be rotated around the hinge axis into and out of a chosen groove of the rack in order to lock the vertical movement of the seat.

According to a further aspect of the invention the highchair comprises a seat made of a substantially rigid material, and removable accessories such as a harness, a bumper bar, a crutch bar and/or a footrest, said seat and accessories comprising attachment means for attaching the accessories to the seat, wherein said attachment means comprises at least one slot in said seat and at least one attachment clip on said accessory that fits into said slot, said clip and slot combination comprising a resilient tongue and edge snap connection that lock said clip into said slot upon insertion, and wherein said slot is formed such, that said snap connection can be released by inserting an unlocking tool into said slot.

According to a still further aspect of the invention the highchair comprises a base arranged to rest on a floor, a seat comprising a seat member and a leg support member extends downwardly from a front edge of the seat surface, the leg support member is slidable mounted on the base, a locking device mounted between the base and the leg support member and movable between a locked position and unlocked position so as to lock the seat at a desired height relative to the base. Preferably the base includes two inverted U shaped legs and a cross member connected between the two legs, the locking device is mounted on between the cross member and the leg support member. Preferably the locking device includes a lever pivotally connected mounted on the support member with a cam surface, and at least one substantially vertical rack mounted on the base having a scalloped surface with plurality of ridges and grooves, when the locking device is in the locked position, the cam surface is engaged with the one of the grooves to lock the seat at the desired height relative to the base. Preferably the rack is in the form of a T-profile, the leg support member of the seat includes an extrustion mated with the rack so that the leg support member is detachably connected to the base and can slide along the rack According to a still further aspect of the invention the highchair comprise a base frame, a seat comprising a seat member and a leg support member extends downwardly from a front edge of the seat surface, the seat is movable mounted on the base and the leg support member includes a main portion and a cover portion pivotally connected to the main portion, wherein the cover portion of the leg support member is moved between a first position where the cover plate is in the same horizontal plane of the main portion and the seat is locked relative to the base in a desired height position; and a second position where the cover plate is pivoted relative to the main portion to an forward position and the seat is free moved relative the base.

According to a still further aspect of the invention the highchair comprises a base frame includes two inverted U shaped legs and a cross member connected between the two legs, a seat comprising a seat member and a leg support member extends downwardly from a front edge of the seat surface, the leg support member is detachably mounted on the cross member and having a latch clip to prevent the seat from being removed from the base. Preferably the cross member of the base includes a rack in the form of a T-profile, the leg support member of the seat includes an extrustion mated with the rack so that the leg support member is able to slide relative to the base to a desired height position, and the latch is attached to the extrusion so as to extend under the T-profile.

Further aspects of the invention and advantages thereof are described in the following detailed description of the preferred embodiment.

BRIEF DESCRIPTION OF THE DRAWINGS

The invention will be further explained by means of the preferred embodiment as shown in the accompanying drawings, wherein.

DETAILED DESCRIPTION OF THE PREFERRED EMBODIMENT

Figure 1C:
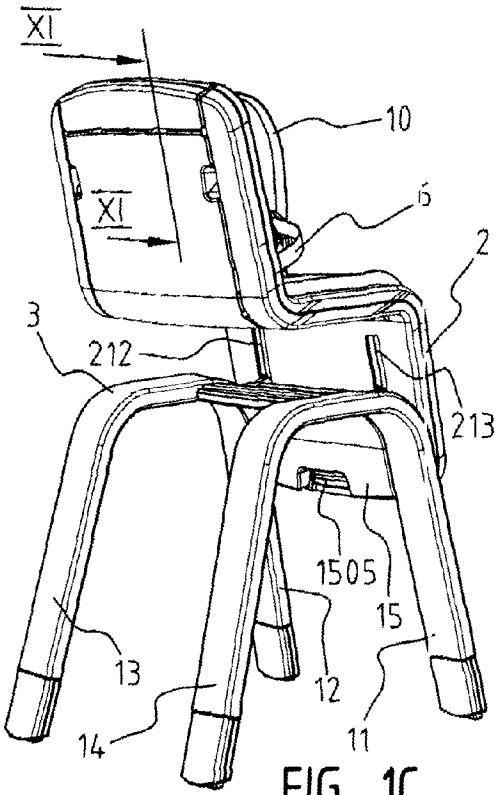
FIGS. 1A/B/C shows perspective views of a modular highchair with accessories in accordance with the invention.

In the figures is shown a highchair 1 that has height adjustment, and a number of removable components that give the highchair modularity. The highchair 1 comprises of a seat 2, a base 3 and a number of removable components such as a footrest 4, tray table 5, a harness 6 complete with buckle 7, a combined bumper/crutch bar 8,9, and a cushion 10. The base 3 forms the legs 11, 12, 13, 14 of the chair 2 and the seat 2 moves vertically over the front of the legs 11, 12 to provide the height adjustment. The seat 2 is locked in position vertically by means of a mechanism 15 such as an over centre cam 1501 which clamps onto a component of the base 3. The form of the seat 2 consists of a seat surface 201, an upwardly extending back surface 202 and a downwardly extending leg surface 203. The base 3 consists of two inverted U shaped legs 301, 302 with a cross member 303 that runs between the two front straight sections of the legs. The leg surface 203 of the seat 2 is connected to this cross member 303 and can slide vertically over this surface when the mechanism lock 15, which comprises for example an over centre cam 1501, is released. The height adjustment movement is assisted by means of motion control hardware, such as gas springs 1502.

Figure 1B:
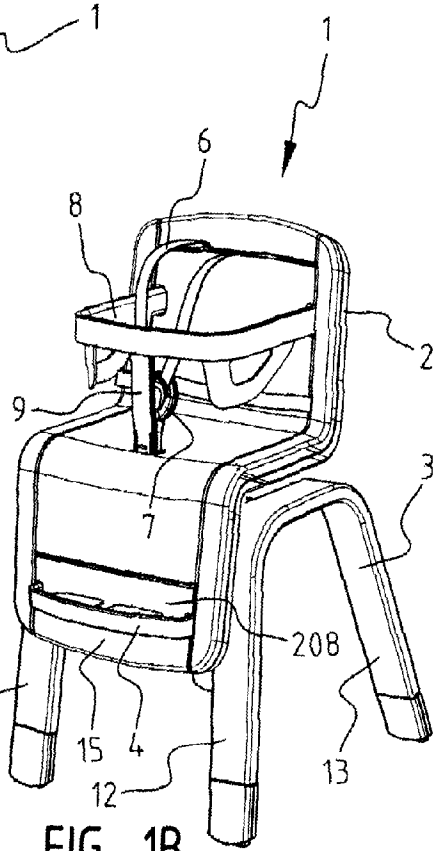
Figure 1A:
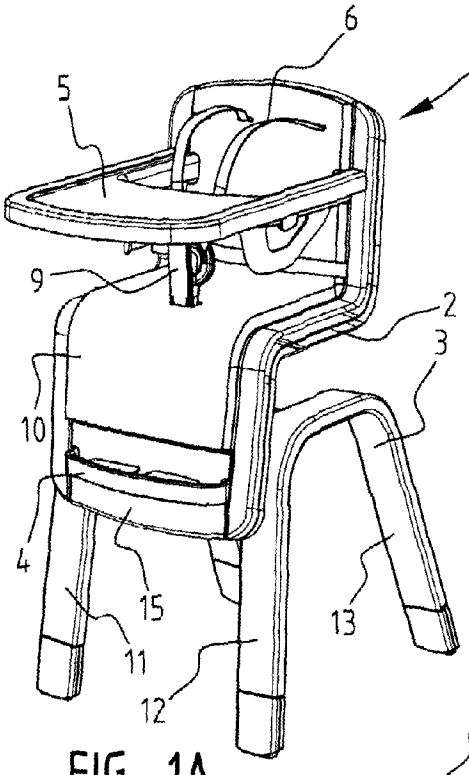
Figure 2:
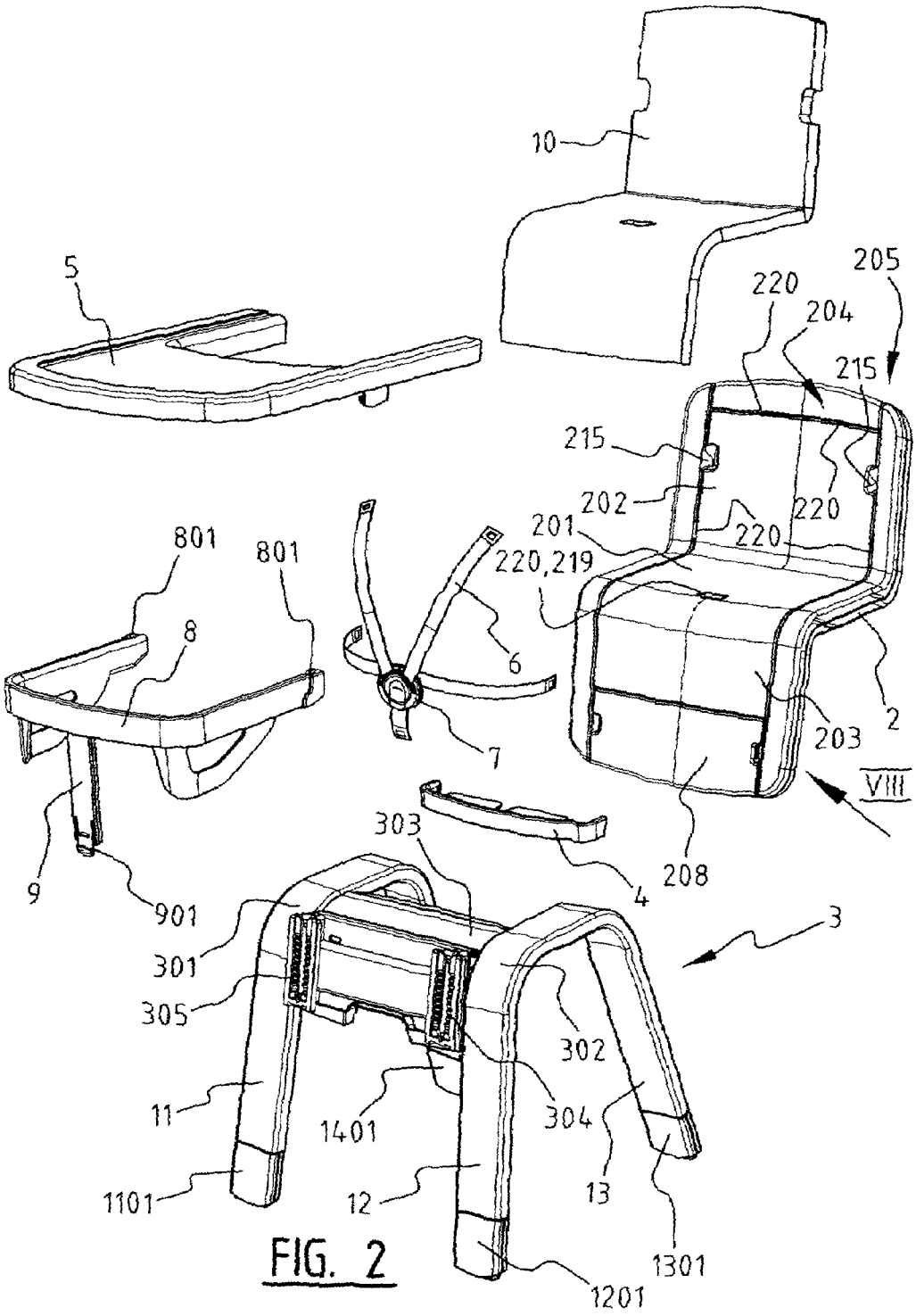
FIG. 2 shows a perspective exploded view of the modular highchair with accessories of FIG. 1.

As shown in FIGS. 1 and 2 the highchair comprises of a seat 2, a base 3 and a number of removable components such as a footrest 4, tray table 5, a harness 6 complete with buckle 7, a combined bumper/crutch bar 8, 9, and a cushion 10.

Figure 5C:
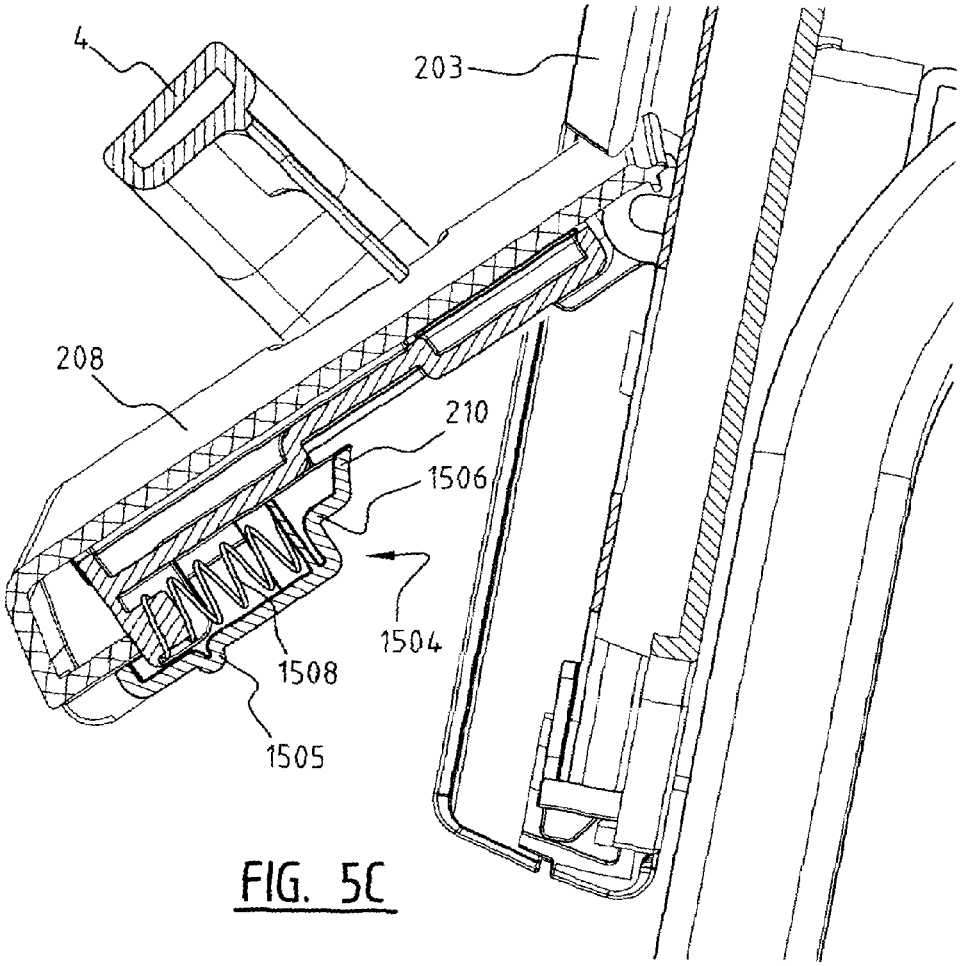
Figure 6:
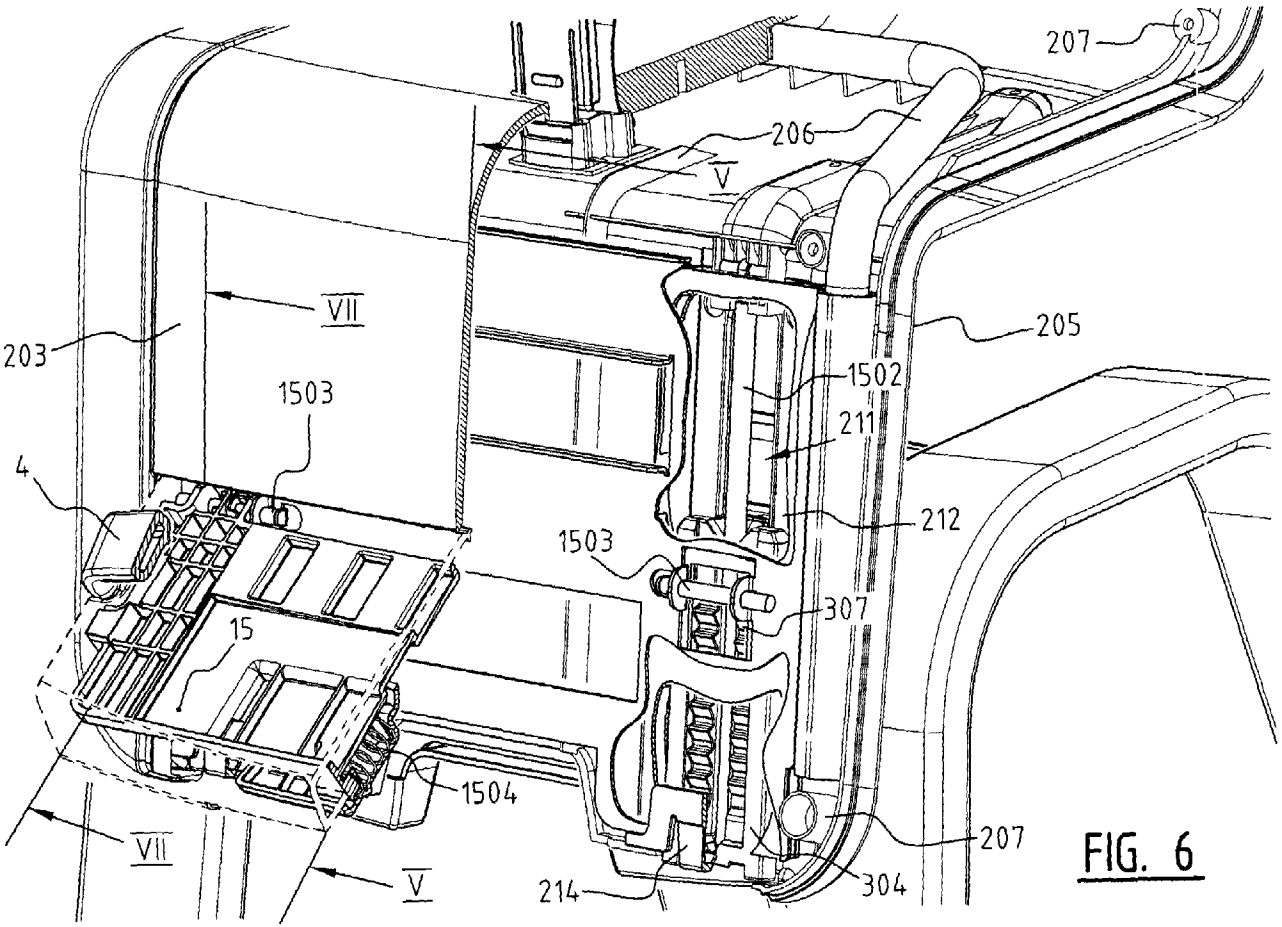
FIG. 6 shows a partly open perspective view of the carrier with locking mechanism of the highchair of FIG. 1.
Figures 7A, 7B:
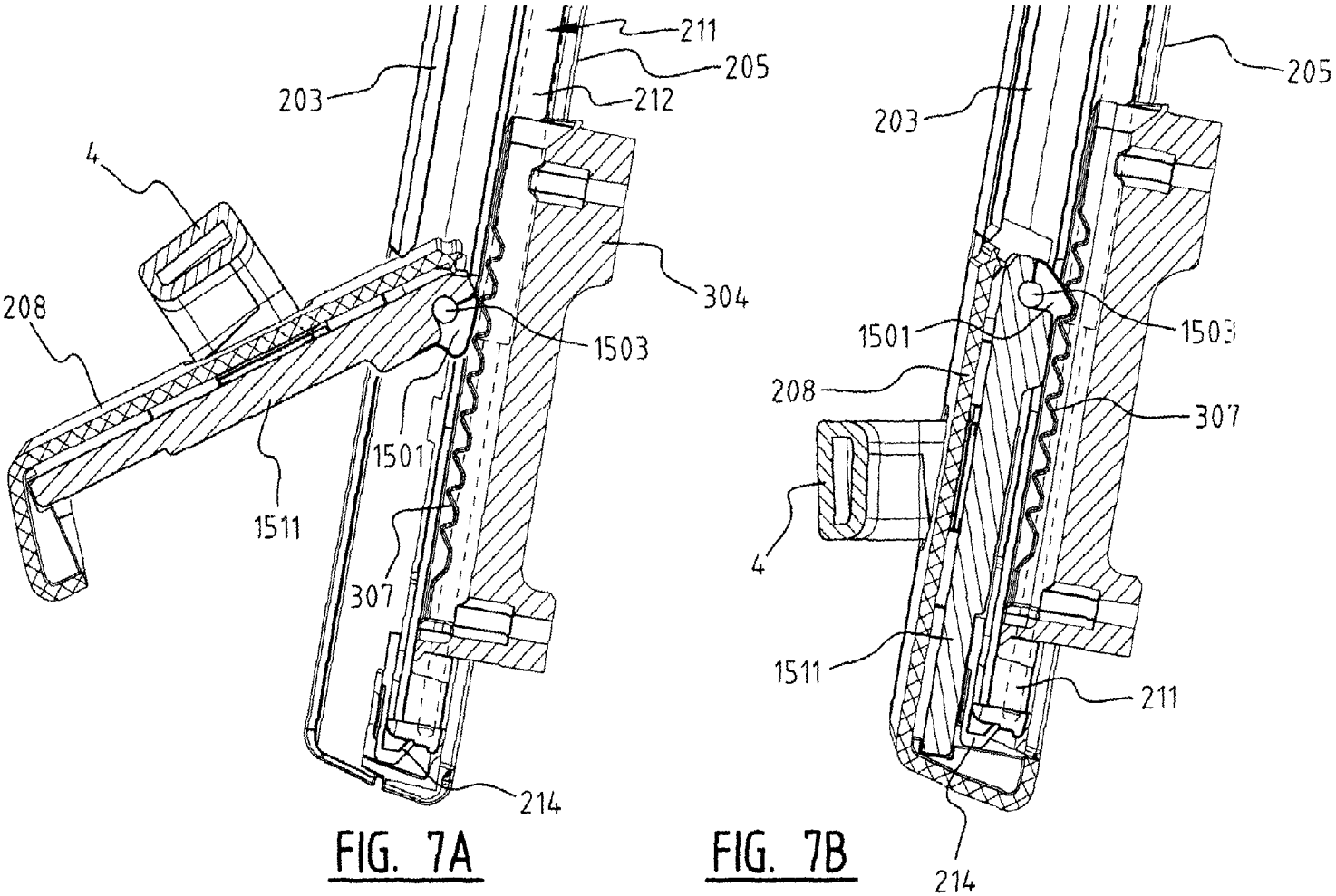
FIG. 7A/B shows a cross-section of the carrier with the locking mechanism of the highchair of FIG. 1.

The form of the seat 2 consists of a seat surface 201, an upwardly extending back surface 202 and a downwardly extending leg surface 203. The seat exterior is made from, for instance, an injection moulded plastic, such as Polypropylene, and consists of two major parts, a front shell 204 and a back shell 205. An internal frame 206 is sandwiched between these two shells 204, 205 and the three parts are fastened together, preferably using a combination of snaps 207 and screws as shown in FIG. 6. The internal frame 206 is made from, for instance, folded sheet steel. This internal frame 206 provides some additional rigidity to the seat 2 and has a further two functions. The first is to provide the height adjustable connection between the seat 2 and the base 3 and the second is to house the axle 1503 for the rotating the mechanism 15, which comprises for example an over centre cam component 1511, that locks the height adjustment as shown in FIGS. 5C, 6 and 7A/B. A section of the leg surface 203 of the front and back shells 204, 205 is open and a separate moveable cover 208 fills the gap. This moveable cover 208 is attached to the over centre cam (or similar) component 1511. The moveable cover 208 and the cam component 1501 are made, for instance, from injection moulded polypropylene. The cam component 1511 and the moveable cover 208 fit together to form the height adjustment lock handle assembly 15 as shown in FIGS. 5C, 6 and 7A/B. This part also houses a secondary latch assembly 1504. The secondary latch assembly 1504 is comprised of a lever handle 1505 and a latch 1506 and is attached to the back of the moveable cover 208. The latch 1506 and lever handle 1505 are, preferably, injection moulded polypropylene components. A compression spring 1508, or similar actuating component, fits between the moveable cover 208 and the latch 1506 to keep the latch 1506 in the upward (locking) position. When the moveable cover 208 is rotated to its lock position (flush with the front and back shells 204, 205) the latch 1506 fits behind a section of the internal frame 206. The latch 1506 also contains an angled surface 210 as shown in FIG. 5C so that the internal frame 206 pushes the latch 1506 down when the moveable cover 208 is rotated to the locked position. The back shell 205 incorporates two long slots 211, behind which are, for instance, two aluminium extrusions 212, 213 that are fastened to the internal frame 206. Inside both of the slots 211 are located gas springs 1502 (or similar devices). The top end fittings of the springs 1502 are retained by the back shell 205 and the internal frame 206. The lower end of the gas spring 1502, the pin, has a small rounded or chamfered plastic cap to aid in the assembly of the seat 2 to the base.

Figure 4:
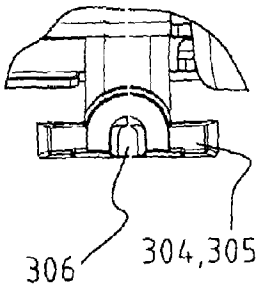
FIG. 4 shows a top view of the guide member as shown in FIG. 3.
Figure 3:
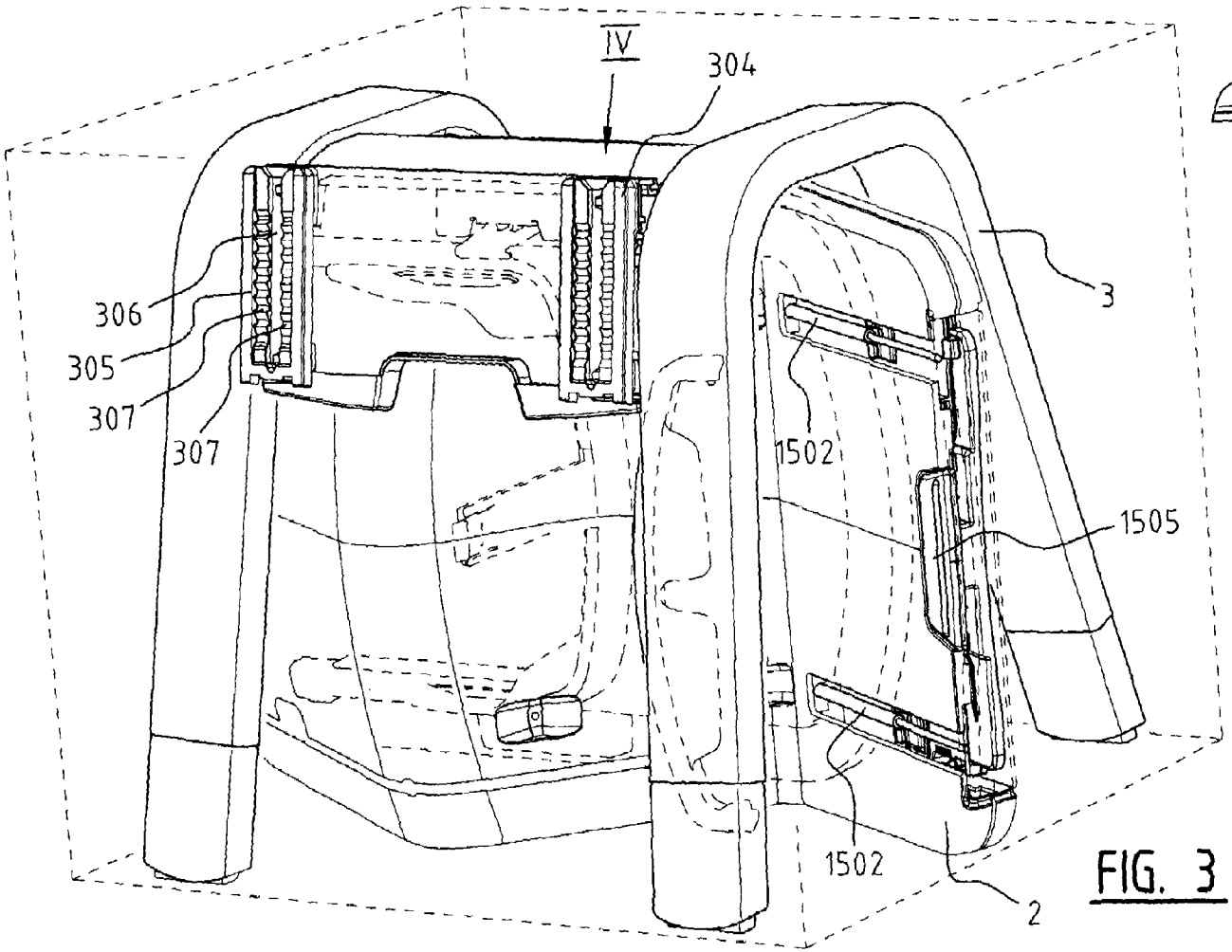
FIG. 3 shows a perspective view of the disassembled modular highchair of FIG. 1 in a box.

The base 3 as shown in FIGS. 2 and 3 consists of two inverted U shaped components 301, 302 which create four legs 11, 12, 13, 14 with a single cross member 303 that runs between the front two 'legs' 11,12. The two inverted U shaped components 301, 302 are made from, for instance, rectangular Aluminium extrusion that is bent to comprise three straight sections and two radii. Each inverted U component 301, 302 provides a front and back leg. The front and back legs 11, 12, 13, 14 are not parallel and the angle between the top of the inverted U shape and the legs on either side is greater than 90 degrees. The two inverted U shape components 301, 302 are separated by a cross member 303 that fits between the two front 'legs' 11, 12. The two inverted U shape components 301, 302 are also not parallel with each other as they are angled outwards at the foot end. The cross member 303 is, for instance, a folded sheet steel component with an injection moulded polypropylene cover. The cross member is fastened between the two front legs 11, 12. Four feet 1101, 1201, 1301, 1401 are fitted into the cut ends of the legs 11, 12, 13, 14. The feet are likely to be made from injection moulded polypropylene. Fastened to the cross member 303 are two injection moulded T-profiles 304, 305 as shown in FIGS. 3 and 4, which are for instance made from POM or Nylon. These two profiles 304, 305 are made to fit inside the two aluminium extrusions 212, 213 that are attached to the internal frame 206 of the seat. The T-profiles 304, 305, in length, are longer than the height adjustment range. They have a recess 306 down the middle to house the gas spring 1502 (or similar device) and they have a scalloped surface section 307 on which the cam component 1501 clamps against. The top end is chamfered to provide ease of assembly.

On assembly of the seat 2 and the base 3, the two aluminium extrusions 212, 213 in the seat 2 are slid over the two T-profiles 304, 305 of the base. As this is done, the pin end of the gas springs 1502 complete with end caps comes into contact with the end wall of the T-profiles 304, 305 and this begins to compress the gas spring 1502. When the seat 2 reaches its highest most lockable position in relation to the base 3, two plastic latch fingers 214 clip under each T-profile 304, 305 to prevent the seat from being removed again accidentally. These plastic latch fingers 214 are attached, for example, to the aluminium extrusions 212, 213 of the seat frame work.

Figure 8:
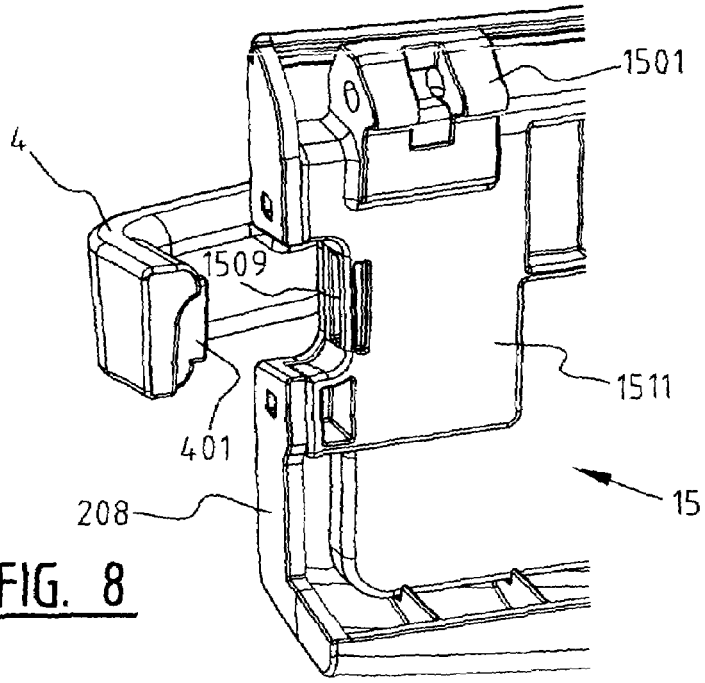
FIG. 8 shows a perspective view of a detail of the carrier with footrest of the highchair of FIG. 1.

In addition there are a number of removable parts. There is a footrest 4 as shown in FIGS. 2 and 8 which will be made for instance using gas assisted injection moulding of polypropylene. This is attached to the height adjustable lock handle assembly 15, and therefore moves with it. When the height adjustable lock handle assembly 15 is in the unlocked position, the foot rest 4 can be easily removed by flexing it open. Two protrusions 401 fit into two slots 1509 in the cam component 1511.

Figure 9C:
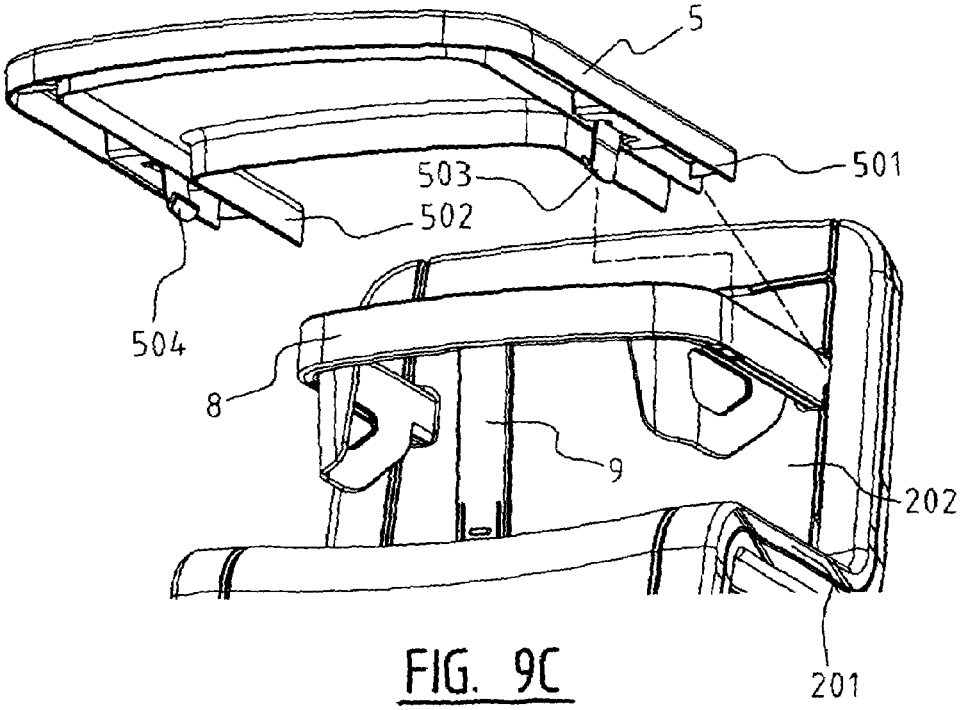
FIG. 9C shows a perspective view of a detail of the highchair of FIG. 1 with bumper bar, crutch bar and tray.
Figure 9A:
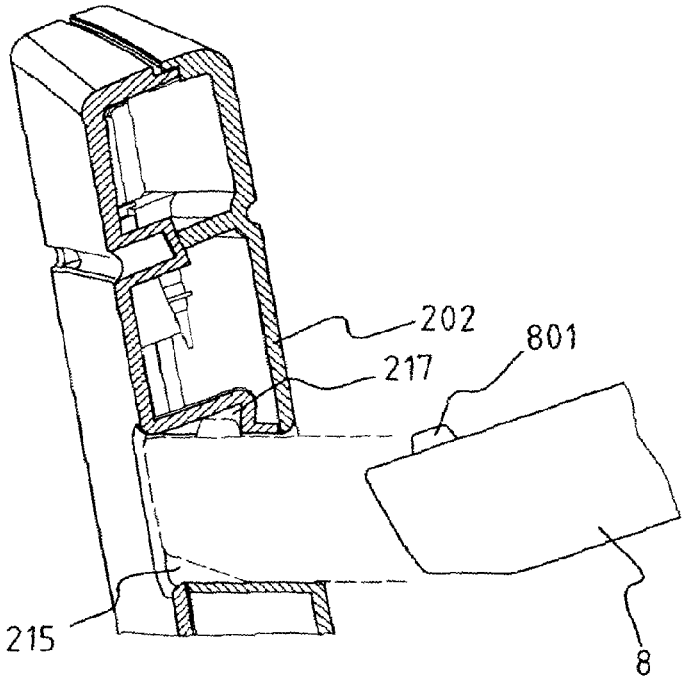
FIG. 9A shows a perspective cross-section of the connection of the bumper bar with the backrest of the highchair of FIG. 1.
Figure 9B:
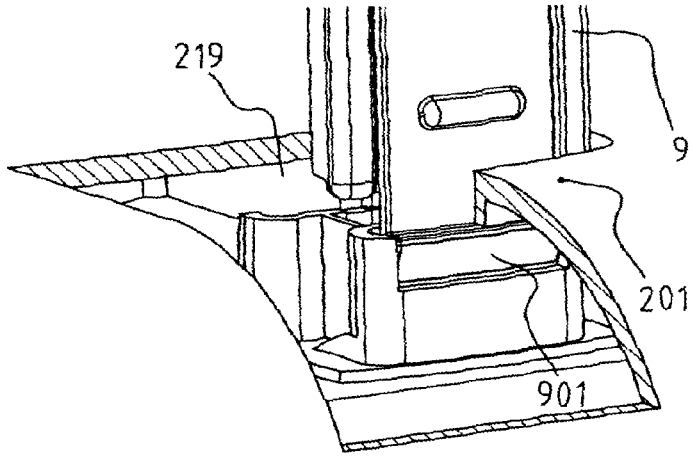
FIG. 9B shows a perspective view of the connection of the crutch bar with the seat surface of the highchair of FIG. 1.

There is also a bumper bar 8 as shown in FIGS. 2 and 9A/B that is permanently attached to a crutch bar 9 by means of snaps for example. The ends of the bumper bar 8 are rotated into through-holes 215 in the back surface 202 of the seat 2. A small protrusion 801 on the ends of the bumper bar 8 fits into a small recess 217 in the through-holes 215 in the back surface 202, thereby holding the bumper bar/crutch bar 8, 9 assembly in place when the crutch bar 9 is clicked in place. The crutch bar 9 has a flexible snap 901 which, when the end of the crutch bar 9 is pressed into a through-hole 219 in the seat surface 201 of the seat 2, clicks into place locking the whole assembly. By pushing on a section 902 of the crutch bar 9 the snap 901 is pushed back and the crutch bar/bumper bar 8,9 can be removed. These parts are to be made from, for instance, gas assisted injection moulding of polypropylene.

Figure 10A:
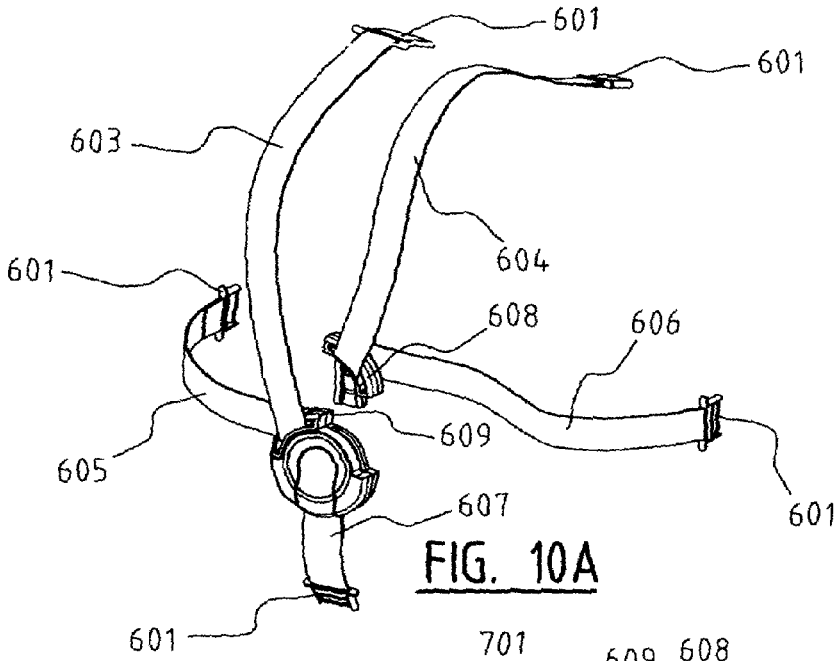
FIG. 10A shows a perspective view of the harness of the highchair of FIG. 1.
Figure 10B:
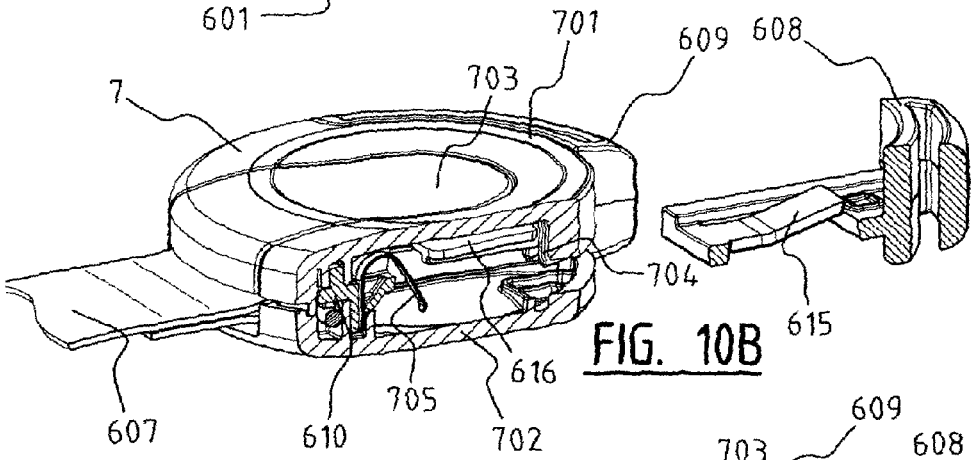
FIGS. 10B/C show perspective cross-sections of the buckle of the harness of FIG. 10A.
Figure 10C:
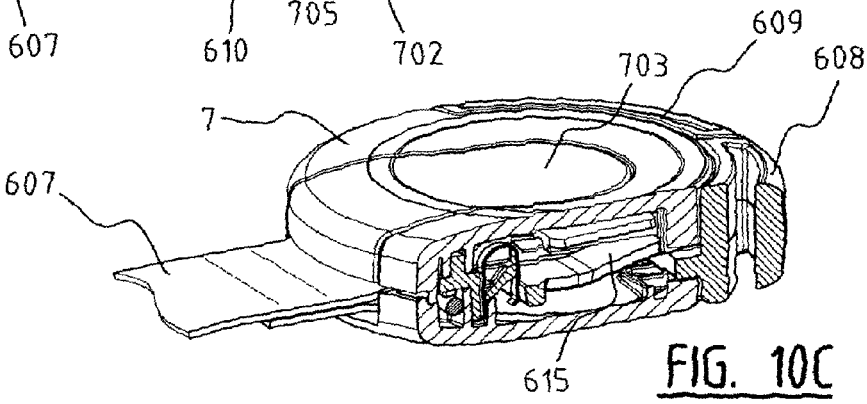
Figure 11B:
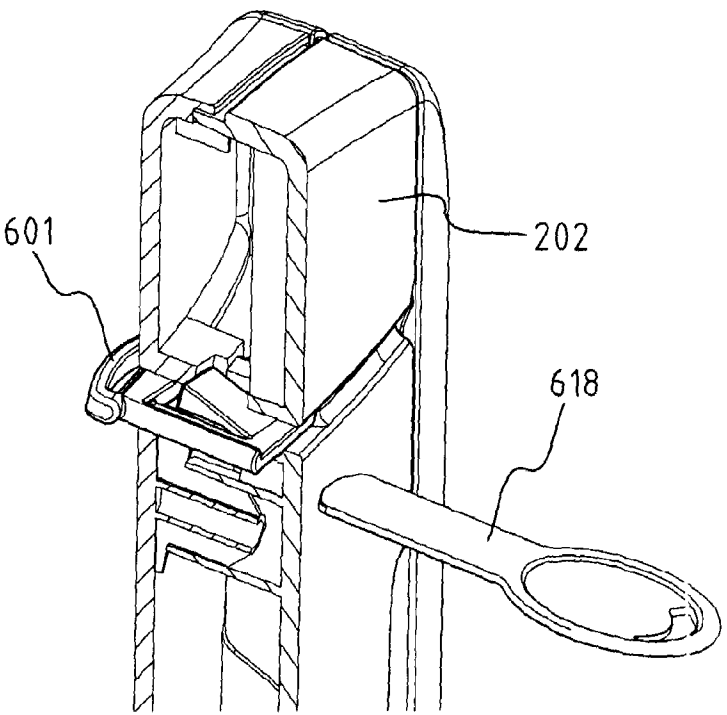
FIGS. 11A/B show a perspective cross-sections of the connection between the harness and the seat of the highchair of FIG. 1.
Figure 11A:
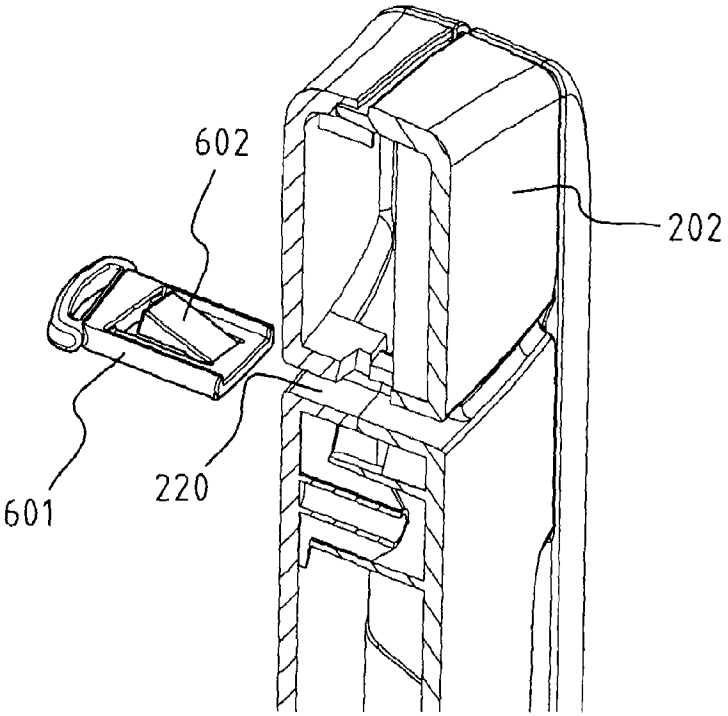

As shown in FIGS. 2, 10A and 11A/B there are five attachment clips 601 that allow attachment of the harness 6 to the seat. These attachment clips 601 fit into through-holes 220 in the back surface 202 and seat surface 201 and are held in place by a snap 602 moulded into each attachment clip. To remove the harness 6 a tool 618 needs to be inserted from the back/underside of the seat 2 to release the snap 602. There are two attachment clips 601 for the left and right shoulders 603, 604, two for the left and right waist 605, 606 positions and one for the crutch position 607. These attachment clips 601 are to be, for instance, made from injection moulded polypropylene. A soft webbing is used for the harness 6. Three lengths are used. One length runs from the left shoulder to the left waist position and contains a buckle clip 608. One length runs from the right shoulder to the right waist position and also contains a buckle clip 609. The other length joins the crutch attachment clip 610 to the buckle 7. The buckle 7 as shown in FIGS. 10A/B/C, including the two buckle clips 608, 609, is made from five plastic components that are for instance made from injection moulded ABS (Acrylonitrile Butadiene Styrene). There is the front half 701 and back half 702, which comprise the buckle housing; a flexible button 703; and two buckle clips 608, 609 that each contain a flexible snap 615, 616. When the button 703 is compressed, it causes the flexible snaps 615, 616 to release from behind a rib 704 in the front half 701. Two compression springs 705 are incorporated to propel the buckle clips 608, 609 out of the buckle housing upon compression of the button 703.

A tray table 5 fits over the bumper 8 bar as shown in FIGS. 1A, 2 and 9C. Two protruding ribs 501, 502 fit into the through-holes 215 of the back surface 202 of the seat 2 along side the bumper bar ends. Two tray snaps 503, 504 are located in the inside edge of the tray and click to the bumper bar 9. To release the tray 5 these snaps 503, 504 are bent rearwards and then the tray 5 can be pulled up and away from the seat 2. This part will be made for instance from injection moulded polypropylene. A removable foam cushion 10 as shown in FIGS. 1A/B/C and 2 can be added to the seat 2 for small babies.

The cube size of a product, prior to being purchased by a consumer, needs to be minimised to make best use of shipping container capacity and to minimise storage requirements. In order to minimise the cube size of the boxed highchair 1, the seat 2 and the base 3 are produced as two separate parts which allows them to be nested together in a box and therefore conserve space, as shown in FIG. 3.

It is desired that a consumer be able to assemble the highchair 1 with ease without following extensive instructions and without the need for tools. It is also preferable that a consumer be able to disassemble the highchair 1 and return it to its original box should they need to return the product to the factory for repair, be moving house or want to put the product into storage. However this should only occur through a deliberate action. Disassembly should not occur by accident.

The two parts are easily fitted together by the consumer by first fully opening the height adjustment lock handle assembly 15 and then sliding the two aluminium extrusions 212, 213 in the back of the seat 2 over the two T-profile components 304, 305 of the base. Two gas springs 1502 will begin to exert a force as the seat 2 is pushed over the profiles 304, 305. As the seat reaches its highest lockable position in relation to the legs 11, 12,12, 14, a "click" sound will be heard indicating that the seat 2 is now attached to the legs 11, 12, 13, 14. The seat 2 and legs 11, 12, 13, 14 can now only be separated when required only through a deliberate action.

Incorporated into the seat 2 are two aluminium extrusions 212, 213 or similar. These two parts slide over the two T-profiles 304, 305 that are attached to the cross member 303 between the legs 11, 12, 13, 14 of the base. Two gas springs 1502 (or similar devices) are situated in the centre of each of the two pieces of aluminium extrusion 212, 213 and these fit inside the two T-profiles 304, 305 when the seat 2 is assembled onto the base 3. One end of each of the gas springs 1502 is connected to the seat 2 and as the seat 2 is assembled on to the base 3 the other end of each of the gas springs 1502 makes contact with the end wall of the T-profiles 304, 305. When the seat 2 is pushed down to its highest lockable position with relation to the leas 11; 12, 13, 14, four plastic latch fingers 214 (that are elastically deformed during the assembly) snap back into position preventing the seat 2 from being removed from the base 3. These must be pushed apart before the seat 2 can again be removed from the base 3.

The consumer would like their purchase to serve them for as long a time as possible. By adding a height adjustment mechanism to a high chair 1, the chair 1 can be used for a longer period of time. The chair 1 is able to be lowered as the child grows. Also the height adjustment allows for the parent to adjust the chair 1 should they want to feed the baby while they are themselves, for example, seated on a couch.

Should the consumer fail to lock the height adjustment mechanism, through normal use of the highchair 1, the mechanism should lock itself. It should also be visually obvious to the consumer whether or not the highchair 1 height position is locked. It is furthermore desired that the height be adjustable to any chosen position between the highest and lowest available positions rather than restricting adjustment to only a few positions. It is also required that the height adjustment be easily performed by an adult using both hands. It is also important that the height adjustment can not be accidentally released by either the child in the high chair 1 or a sibling. Furthermore it is desired when the height is locked that any play between the seat 2 and the base 3 will be removed or at least minimised so that there is no rattling or feeling of instability/flexibility that would serve to give the chair 1 an unsafe feel.

Figure 5A:
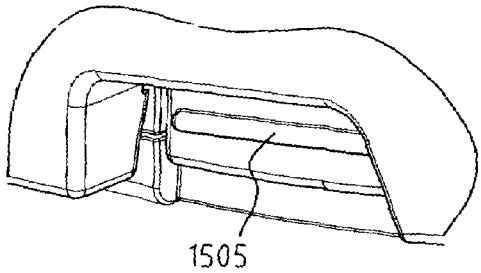
FIGS. 5A/B shows perspective views of the secondary locking mechanism of the highchair of FIG. 1.
Figure 5B:
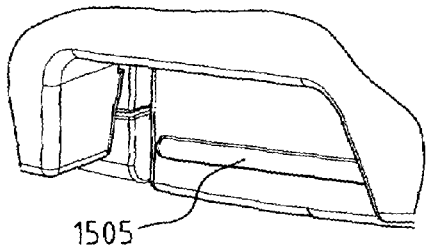
FIG. 5C shows a cross-section of the carrier with the secondary locking mechanism and the footrest of the highchair of FIG. 1.

The locking function as shown in FIGS. 5A/B/C, 6 and 7A/B consists of a primary and a secondary locking device 15, 1504. The primary locking device 15 uses, for instance, an over centre cam quick-release type lock. The cam 1501 is positioned so that when a load is applied to the chair 1 the cam 1501 will rotate to the locked position. This means that whenever a child is seated in the chair 1 the weight of the child will cause the mechanism to lock. When locking, the cam 1501 comes into contact with a scalloped surface 307 on the T-profile 304, 305. The scalloped surface 307 is used to increase the contact area between the cam 1501 and the clamping surface and also increases the vertical component of force, to oppose forces that would initiate movement in the upwards or downwards directions. When the cam 1501 is in the locked position it pushes firmly against the T-profile 304, 305, thereby removing any play between the seat 2 and the base 3 and creates a rigid structure.

When the height adjustment lock handle assembly 15 is in the unlocked position, it is sticking out from the leg surface 203 of the seat 2. Therefore it is obvious to the user if the seat 2 is not in the locked position.

Because a cam type mechanism is used rather than the more usual pin/hole type mechanism, there is less limitation in the number of positions available for the seat 2 to be set at. The addition of gas springs 1502 (or similar devices), which gently propel the seat 2 in the upward direction when the cam 1501 is released, simplifies the height adjustment. The user can push down on the seat 2 with one hand and when the desired height is achieved can then lock the seat 2 using the other hand.

Without gas springs 1502 (or similar devices) the user would need to pull the seat 2 up to the desired position which is a more difficult action. This would create the possibility that the whole chair 1 is lifted off the floor rather than only the seat 2 being moved upward or the possibility that the seat 2 is pulled on one side only, which could lead to the seat 2 becoming skewed and adjusting would then become difficult.

The prevention of accidental release is provided through a secondary latch 1504 which must first be released before the height adjustment lock handle assembly 15 can rotate. The secondary latch 1504 is released by sliding the lever handle 1505 down as shown in FIG. 5A/B. The rotating follows the sliding movement providing a smooth secession of movements rather than two disjointed movements.

As described previously, the seat 2 contains, for instance, two aluminium extrusions 212, 213 which slide over two T-profiles 304, 305 that are attached to the cross member 303 between the legs 11, 12, 13, 14 of the base 3. In the centre of the extrusion 212, 213 there is a cut-out which allows the cam 1501 from the cam component 1511 to protrude through. The two T-profiles 304, 305 on the cross member 303 of the legs 11, 12, 13, 14 have a scalloped surface 307 which the cam 1501 makes contact with when in the locked position. The cam component 1511 itself is attached to the moveable cover 208. Inside of the plastic seat shells 204, 205 is the internal frame 206 which contains the axles 1503 that the cam 1501 (and height adjustable lock handle assembly 15) rotate about.

The secondary latch 1506 is located on the back of the height adjustable lock handle assembly 15 and can be slid downwards with the fingers, allowing the cam 1501 to be rotated. When in the upwards position the latch 1506 fits behind a section of the internal frame 206 which prevents the rotating of the cam 1501. When the lever 1505 is moved downward the latch 1504 is also moved and the cam 1501 is then free to rotate. A compression spring 1508 fits between the moveable cover 208 and the latch 1506 to keep the latch 1506 in the upward (locked) position. The latch 1506 is pushed down by the seat's internal frame 206 pushing against an angled section 210 of the latch 1506.

As well as suiting a range of ages it is desirable for the child's caregiver that the highchair 1 can be modified to suit the particular child's needs as well as those of the caregiver.

The tray 5 should be removable for cleaning and the highchair 1 should still be able to be used without the tray 5. Also the relevant Standards state that a crotch bar 9 is mandatory when the tray table 5 is in use. For small babies a harness 6 is desired but this should be able to be removed for bigger children. It is desired that both the footrest 4 and bumper bar 8 be removed when they are no longer required.

The seat can be easily changed as the baby grows and their needs change. The high chair 1 can be converted from a standard baby's high chair 1 to a normal child's chair 1 by removing the different components as shown in FIG. 1. The tray 5 can only be used when the crotch bar/bumper bar 8, 9 is in place thereby complying with the Standards. Once the tray table 5 is removed, the crotch bar/bumper bar 8, 9 is still in place giving extra versatility to the high chair 1.

A soft cushion 10 is included in the design for very young children. When the child is bigger this can be removed by first removing the harness 6. The harness 6 is attached to the chair 1 by means of attachment clips 601 that can only be removed by use of a tool 618. The tool 618 must be inserted into the slots 220 in the back shell of the seat 2 and this in turn pushes a flexible snap 602 of the attachment clip 601 away allowing the attachment clip to be released. The tray 5 is easily removed by first releasing the tray snaps 503, 504 on the inside of the tray 5 and then sliding the tray out of the slots 215 in the back surface of the seat 2. The bumper bar 8 is released in a similar manner. There is a snap 901 in the crutch bar 9 that is released by pressing on a flexible section 902 of the bar 9. This then allows the crutch bar 9 to be pulled out. The bumper bar 8 can then be rotated out of the slots 215 in the back surface of the seat 2. The foot rest 4 can be removed by first releasing the height adjustment lock handle assembly 15, and then the foot rest 4 can be detached one side at a time by pulling the footrest 4 open.

Buckles that are complicated to fasten are less likely to be used by the caregiver. It is desirable that the harness buckle 7 be simple and easy to use by the caregiver. The buckle 7 is attached to the length of webbing that fits between the child's legs. Two buckle clips 608, 609 are attached to two lengths of webbing, one that goes over the left shoulder of the child and to the left of the child's waist and one that goes over the right shoulder of the child and to the right of the child's waist. The two buckle clips 608, 609 can be clipped independently into the buckle 7.

The buckle 7 is made from five plastic components. The front half 701 and back half 702 of the buckle 7, which comprise the buckle housing; a flexible button 703 and two buckle clips 609, 610 containing a flexible snap 615, 616 that is flexed on compression of the button 703 and is released from behind a rib 704 in the back half 702. Two compression springs 705 are incorporated to propel the clips 608, 609 out of the buckle housing on compression of the button 703.

Although the invention is described herein by way of the preferred embodiment as an example, the man skilled in the art will appreciate that many modifications and variations are possible within the scope of the invention.

The invention claimed is:

1. A highchair comprising a base arranged to rest on a floor, and a seat mounted on said base and adjustable in a substantially vertical direction with respect to said base, the seat comprising a substantially horizontally extending seat surface, wherein said seat extends substantially downward from a front edge of said seat surface, and wherein the highchair comprises a locking device for locking the seat at a desired height relative to the base and the locking device is mounted between the base and the seat and comprises a lever movable between a locked position and unlocked position so as to lock the seat at the desired height, wherein said lever is plate shaped and is integrated in the seat, which is plate shaped, in the locked position, and wherein the lever is hinged and mounted on the seat with at least one cam, and at least one substantially vertical rack mounted on the base having a scalloped surface with ridges and grooves, such that the cam is contactable with the scalloped surface in order to lock the vertical movement of the seat.

2. The highchair according to claim 1, wherein said seat is mounted on, and movable up and down along the front side of said base.

3. The highchair according to claim 1, wherein a backrest extends substantially upward from the rear edge of said seat surface.

4. The highchair according to claim 1, wherein said seat extends downward and slightly forward from said front edge of said seat surface.

5. The highchair according to claim 1, wherein said seat forms a leg support.

6. The highchair according to claim 1, wherein said base comprises two spaced apart front legs.

7. The highchair according to claim 1, wherein said base comprises two spaced apart rear legs.

8. The highchair according to claim 1, wherein said base comprises two spaced apart front legs and a cross member connected to the front legs, wherein said carrier is movable on the cross member.

9. The highchair according to claim 8, wherein said front and rear legs are connected by a horizontally extending substantially H-shaped or U-shaped connecting portion.

10. The highchair according to claim 9, wherein said connecting portion is substantially U-shaped, wherein the connecting portion extends near the front side of the base, and said seat is mounted to said connecting portion.

11. The highchair according to claim 1, wherein-the lever is formed by a lower portion of said seat and movable between the locked position wherein said lower portion extends in the lateral plane through the seat, and the unlocked position wherein said lower portion extends in front of said plane.

12. The highchair according to claim 1, wherein said lever is hinged at its upper end, and extends downward abutting a fixed portion of the seat in the locked position.

13. The highchair according to claim 1, wherein said lever comprises a secondary lock for locking the lever against the seat in the locked position.

14. The highchair according to claim 13, wherein said secondary lock comprises an operating handle near the lower edge of the lever for operating the secondary lock.

15. The highchair according to claim 1, wherein said highchair comprises at least one gas spring, one end of which is mounted on the base and the other end of which is mounted on the seat.

16. The highchair according to claim 15, wherein said gas spring extends substantially vertically in the seat.

17. The highchair according to claim 1, wherein said seat is mounted on the base by means of at least one substantially vertical guide member mounted on one of said base and seat, a connector member mounted on the other one of said base and seat, and meshing with said guide member and vertically movable along it.

18. The highchair according to claim 17, wherein said connector member is detachably connected to said guide member, such that the seat is detachable from the base.

19. The highchair according to claim 18, wherein the connector member and guide member are arranged such, that the connector member can be lifted from the guide member if the seat is moved beyond the uppermost position.

20. A highchair comprising a base arranged to rest on a floor, and a seat mounted on said base and adjustable in a substantially vertical direction with respect to said base, the seat comprising a substantially horizontally extending seat surface, wherein the highchair comprises a locking device mounted between the base and the seat for locking the seat at a desired height relative to the base, said locking device comprising a lever movable between a locked position and an unlocked position so as to lock the seat at the desired height, wherein in the unlocked position the lever protrudes out from a front of the seat so as to be clearly visible to a user, and wherein the lever is hinged and mounted on the seat with at least one cam, and at least one substantially vertical rack mounted on the base having a scalloped surface with ridges and grooves, such that the cam is contactable with the scalloped surface in order to lock the vertical movement of the seat.

21. A highchair comprising a base arranged to rest on a floor, and a seat mounted on said base and adjustable in a substantially vertical direction with respect to said base, the seat comprising a substantially horizontally extending seat surface, wherein the highchair comprises a locking device mounted between the base and the seat for locking the seat at a desired height relative to the base, said locking device comprising a hinged lever moveable between a locked position and an unlocked position and mounted on the seat with at least one cam, and at least one substantially vertical rack mounted on the base having a scalloped surface with ridges and grooves, such that the cam can be contacted with the scalloped surface in order to lock the vertical movement of the seat.

22. A highchair comprising a base arranged to rest on a floor, a seat mounted on said base and made of a substantially rigid material, and a harness, a bumper bar, wherein the harness and the bumper bar are removably coupled to the seat so that the highchair can be converted from a baby's highchair to a child's highchair while removing the harness and the bumper bar from the seat, and wherein the seat comprises a seat surface and a seat back surface upwardly extending from the seat surface, and the back surface includes corresponding through-holes for removably inserting ends of the bumper bar, and wherein the highchair comprises a locking device mounted between the base and the seat, said locking device comprising a hinged lever movable between a locked position and an unlocked position and mounted on the seat with at least one cam, and at least one substantially vertical rack mounted on the base having a scalloped surface with ridges and grooves such that the cam is contactable with the scalloped surface in order to lock the vertical movement of the seat.

23. The highchair according to claim 22, wherein the highchair further comprising a footrest removable mounted to the seat.

24. The highchair according to claim 22, wherein the highchair further comprising a tray table to fit over the bumper bar when the high chair is used as the baby's highchair.

25. The highchair according to claim 22, wherein the seat comprise a seat surface, a back surface upwardly extending from the seat surface, the harness has plurality straps that has attachment clip at each ends, the attachment is removable fitted into through-holes in the back surface and seat surface.

26. A highchair comprising a base arranged to rest on a floor, a seat comprising a seat surface and a downward portion extending downwardly from a front edge of the seat surface, the downward portion is slidably mounted on the base, a locking device mounted between the base and the downward portion, and comprising a lever on the downward portion movable between a locked position and unlocked position so as to lock the seat at a desired height relative to the base, wherein the lever is hinged and mounted on the seat with at least one cam, and at least one substantially vertical rack mounted on the base having a scalloped surface with ridges and grooves, such that the cam is contactable with the scalloped surface in order to lock the vertical movement of the seat.

27. The highchair according to claim 26, wherein the base includes two inverted U shaped legs and a cross member connected between the two legs, the locking device is mounted on between the cross member and the extending leg surface.

28. The highchair according to claim 26, wherein the lever is pivotally connected mounted on the support member with a cam surface, and the locking device includes at least one substantially vertical rack mounted on the base having a scalloped surface with plurality of ridges and grooves, when the locking device is in the locked position, the cam surface can be contacted with the scalloped surface to lock the seat at the desired height relative to the base.

29. The highchair according to claim 28, wherein the rack is in the form of a T-profile, extending leg surface of the seat includes an extrusion mated with the rack so that the extending leg surface is detachably connected to the base and can slide along the rack.

30. A highchair comprising a base, a seat comprising a seat member and an extending leg surface extending downwardly from a front edge of the seat surface, the seat movably mounted on the base and the extending leg surface includes a main portion and a cover plate pivotally connected to the main portion, wherein the cover plate of the extending leg surface is moved between a first position where the cover plate is in a same plane of the main portion and the seat is locked relative to the base at a desired height position; and a second position where the cover plate is pivoted relative to the main portion to a forward position and the seat is freely moved relative to the base.

31. A highchair comprising a base including two inverted U shaped legs and a cross member connected between the two legs, a seat comprising a seat member and an extending leg surface extending downwardly from a front edge of the seat member, the extending leg surface being detachably mounted on the cross member and having a latch to prevent the seat from being removed from the base, wherein the highchair comprises a locking device mounted between the base and the extending leg surface for locking the seat at a desired height relative to the base and the locking device comprises a lever movable between a locked position and an unlocked position so as to lock the seat at the desired height.

32. The highchair according to claim 31, the cross member of the base includes a rack in the form of a T-profile, the extending leg surface of the seat includes an extrusion mated with the rack so that the extending leg surface is able to slide relative to the base to a desired height position, and the latch is attached to the extrusion so as to extend under the T-profile.

* * * * *